US005995123A

United States Patent [19]

McCormick

[11] Patent Number: 5,995,123

[45] Date of Patent: Nov. 30, 1999

[54] MARKING AND COUNTING PROBE

[76] Inventor: Erik J. McCormick, 1727 N. 93rd St., Mesa, Ariz. 85207

[21] Appl. No.: 08/963,208

[22] Filed: Nov. 3, 1997

[51] Int. Cl.[6] ..... G03G 9/00; G03G 15/16

[52] U.S. Cl. ..... 346/14 MR; 346/143; 377/1; 401/6; 401/195

[58] Field of Search ..... 346/14 R, 14 MR, 346/143; 377/1, 15; 401/6, 7, 8, 194, 195

[56] References Cited

U.S. PATENT DOCUMENTS

| | | | |
|---|---|---|---|
| 3,064,888 | 11/1962 | VAn De Mark . | |
| 3,120,924 | 2/1964 | Van De Mark . | |
| 4,128,889 | 12/1978 | Ojima . | |
| 4,275,264 | 6/1981 | Houck | 346/143 X |
| 4,601,598 | 7/1986 | Schwartz et al. | 401/6 |
| 4,768,040 | 8/1988 | Pipkin . | |
| 4,993,050 | 2/1991 | Carpenteri et al. | 377/15 |
| 5,354,140 | 10/1994 | Diakoulas | 401/6 |
| 5,442,380 | 8/1995 | McCormick . | |
| 5,506,876 | 4/1996 | Homer . | |
| 5,558,452 | 9/1996 | Oka et al. | 401/6 |

*Primary Examiner*—Sandra Brase
*Attorney, Agent, or Firm*—John D. Lister

[57] ABSTRACT

A marking and counting probe for use with a counter, e.g. a computer, comprises a tubular housing for holding a marking implement, such as a highlighter. One end of the tubular housing has an aperture through which the marking end of the marking implement extends. The other end of the housing is closed and has a switch which is activated by the marking implement when a certain activating pressure is applied to the switch by the marking implement. A resilient means, such as a spring within the switch, keeps the marking implement from activating the switch until the activating pressure is applied to the switch by pressing the marking end of the marking implement against a surface. The switch is connected to a counter whereby, when sufficient pressure is exerted on the switch by the marking implement to activate the switch, a count is recorded. The tubular housing is provided with an open midsection so that a marking implement within the tubular housing can be gripped by the user to mark a surface without actuating the switch to record a count. Thus, the marking and counting probe can be used for both marking and counting.

18 Claims, 2 Drawing Sheets

MARKING AND COUNTING PROBE

BACKGROUND OF THE INVENTION

The present invention is directed to a marking and counting probe and preferably, to a marking and counting probe which can use highlighter pens or similar marking implements to both mark or write on construction plans, prints, papers, documents and other surfaces and count items on such construction plans, prints, papers, documents and other surfaces.

There are many applications where a person desires to both write, highlight or otherwise mark a paper, plan or document and count items on the paper, plan or document. Building construction is one field in which a user frequently desires to mark and/or write on a document and also count items on the document. In building construction, the contractor typically marks and/or writes on a plan or blueprint and counts items, such as electrical outlets, on a plan or blueprint to estimate a job for bidding.

Currently, there are ball point counting pens in use which have a switch that is activated when the counting pen contacts the surface of a plan, blueprint, paper or other document to complete an electrical circuit and send a signal which registers a count on a counter. However, the counting pen activates the switch on every contact so that the counting pen can not be used for marking or writing on a document without activating the switch. Thus, currently, the counting pen is used to count items on a plan or other document and a separate pen or other marking implement is used to mark or write on the document without effecting a count.

My U.S. Pat. No. 5,442,380, issued Aug. 15, 1995, is directed to a marking and counting probe which solved this problem of the prior art by permitting the same marking implement, e.g. a conventional highlighter pen, to be used for marking and writing on a document without effecting a count and for marking and writing on a document while effecting a count. While the marking and counting probe of the '380 patent works very well, there has still been a need to further improve such probes.

SUMMARY OF THE INVENTION

The marking and counting probe of the present invention includes a tubular housing for holding a marking implement, such as, a highlighter, a felt tip pen, or the like. The tubular housing has a first or lower end with an aperture therein through which the marking end of a marking implement within the housing can extend and a sidewall with a lower portion adjacent the lower end of the housing which provides a surface for gripping the housing without gripping the marking implement within the housing. The housing has a second or upper end that is closed and includes a switch. The switch is activated by the upper end of the marking implement when the upper end of the marking implement is pressed against the switch by the movement of the marking implement relative to the tubular housing in the direction of its closed upper end. The tubular housing also has a midsection, intermediate its upper and lower ends, that is provided with an opening or openings in the housing sidewall for providing access to directly grip the marking implement within the tubular housing without gripping the sidewall of the tubular housing whereby the marking implement can be used to mark a surface without activating the switch by directly gripping the marking implement within the tubular housing and the marking implement can be used to count by gripping the lower portion of the sidewall of the tubular housing and pressing the marking end of the marking implement against a surface to cause movement of the marking implement relative to the tubular housing to activate the switch.

The probe switch is part of an electrical circuit and the activation of the switch by the marking implement registers a count on a counting unit that is either integral with the marking and counting probe or a separate unit, such as, a conventional personal computer. Thus, the marking and counting probe of the present invention provides a single implement that can be used to mark and write on a surface without effecting a count by directly gripping the marking implement within the probe housing and also, to effect a count of items on the surface by gripping the housing and pressing the marking implement within the marking and counting probe against the surface with a force sufficient to activate the switch.

Highlighters are generally provided with caps for covering the felt tips of the highlighters to keep the highlighters from drying out when not in use. With most highlighters, a considerable force is required to snap the cap covers for the felt tips into place over the felt tips. With the marking and counting probe of the present invention, by directly gripping a highlighter within the probe, the cap for the felt tip of the highlighter within the probe can be replaced without accidentally effecting a count.

When counting different sets of items on a plan, blueprint or other surface, a user, such as a contractor, normally marks different item sets with different colors to distinguish the item sets being counted from each other. The marking and counting probe of the present invention is provided with an upper end cap that can be easily secured to or detached from the probe. By providing the marking and counting probe of the present invention with such an upper end cap, highlighter pens and other marking implements of different colors can be readily and quickly changed by the user to facilitate the marking of different item sets with different colors as the items are being counted. Thus, the present invention not only provides a marking and counting probe which can be used to mark and write on a surface without effecting a count and to mark on a surface while effecting a count, but the marking and counting probe of the present invention also provides a marking and counting probe which permits the user to readily and quickly change the color of the marking implement used in the marking and counting probe.

DESCRIPTION OF THE PREFERRED EMBODIMENTS

Figure 1:
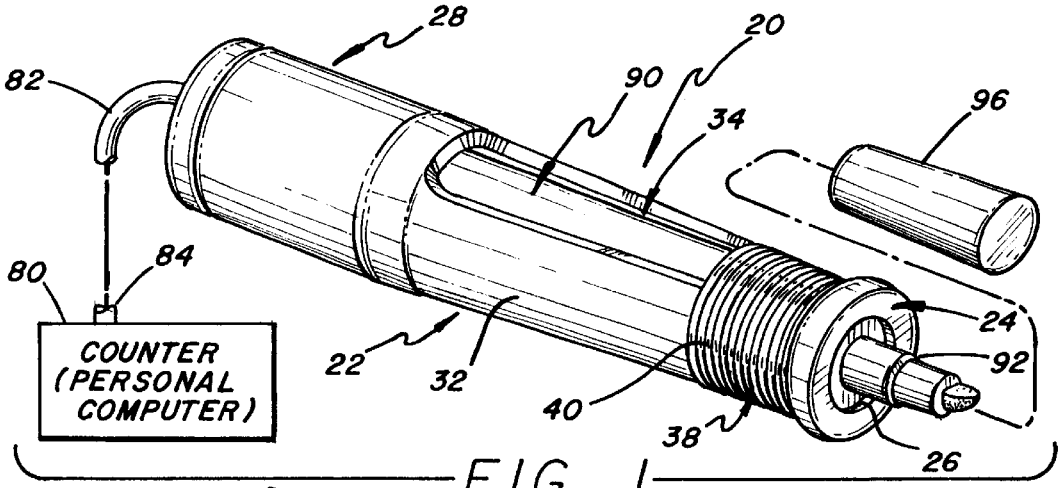
FIG. 1 is a perspective view of a first embodiment of the marking and counting probe of the present invention, connected to a counter such as a personal computer, with an un-capped highlighter marking implement housed within the probe.

FIG. 1 is a perspective view of a first embodiment 20 of the marking and counting probe of the present invention which is electrically connected to a counter 80 (e.g. a personal computer) and, as shown, has a marking implement 90 (e.g. a conventional highlighter pen) housed within the probe. The marking and counting probe 20 of the present invention includes a tubular housing 22 for housing the marking implement 90, such as the highlighter pen. The tubular housing 22 is closed at its lower end 24 except for a centrally located aperture 26 through which the marking end 92 of the marking implement 90 extends when the marking and counting probe 20 is loaded with the marking implement 90 and ready for use. The upper end of the tubular housing 22 of the marking and counting probe 20 is preferably closed by an easily removable end cap 28 which has a switch mechanism 30 incorporated therein.

The tubular housing 22, including the end cap 28, is typically made of black anodized steel or aluminum, plastic, or another suitable material commonly used in the fabrication of pens, mechanical pencils and other marking implements. While, as shown, the outer surface of the tubular housing is generally cylindrical or frusto-conical with a circular transverse cross section, the tubular housing may have other shapes suitable for gripping by a user to mark, write and/or count with the marking and counting probe 20, such as, but rot limited to surfaces formed by tubular housings with oval, square, hexagonal and similar transverse cross sections.

Figure 2:
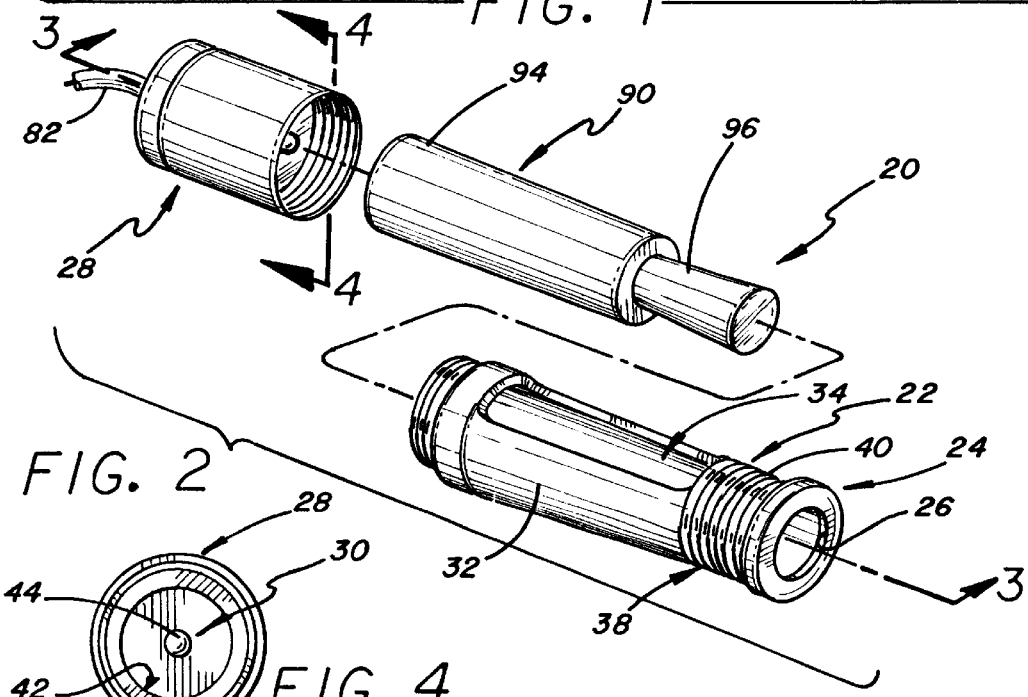
FIG. 2 is an exploded perspective view of the marking and counting probe and the highlighter marking implement (capped) of FIG. 1.
Figure 3:
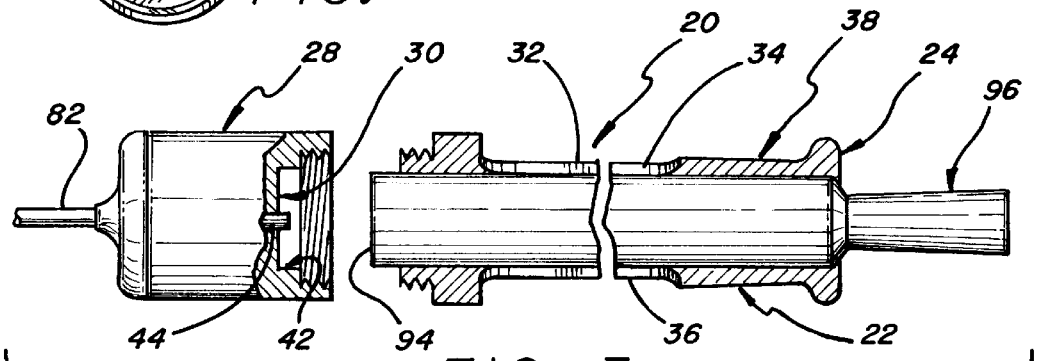
FIG. 3 is a partial longitudinal cross section through the marking and counting probe of FIGS. 1 and 2, taken substantially along lines 3—3 of FIG. 2, with a highlighter marking implement housed within the marking and counting probe.

As shown in FIGS. 1–3 a midsection 32 of the tubular housing 22 is provided with a pair of opposed openings 34 and 36 which provide access to the marking implement 90 within the tubular housing 22 so that the marking implement 90 can be directly gripped within the tubular housing by the user with his/her fingers. While the sizes of the openings 34 and 36 can vary, the openings 34 and 36 must be sufficiently long and wide to permit the ends of the users fingers to easily pass through the openings and grip the marking implement 90 within the tubular housing 22. Preferably, the openings 34 and 36 each extend lengthwise for about one and one half to about two inches, are located and centered on the side portions of midsection of the tubular housing 22, and have widths extending through the side portions of the midsection 32 of the tubular housing, preferably each for at least 90° of the circumference or cross sectional periphery of the midsection.

As shown in FIGS. 1–3 a lower portion 38 of the tubular housing 22 adjacent the lower end 24 of the tubular housing 22 includes an outer surface 40 for gripping the tubular housing without directly gripping the marking implement 90 within the tubular housing 22. The outer surface 40 of the lower portion 38 of the tubular housing 22 can be knurled to facilitate the gripping of the marking and counting probe by the user when the marking and counting probe 20 is being used to mark, write and effect a count.

As best shown in FIG. 3, the inside diameter of the tubular housing 22 is, preferably, substantially equal too but somewhat greater than the outside diameter of the marking implement 90 used in the marking and counting probe 20 so that a snug sliding fit is formed between the marking implement 90 and the tubular housing 22. The opening 26 at the lower end 24 of the tubular housing 22 has a diameter less than that of the marking implement 90 to form an annular shoulder which retains the marking implement within the tubular housing 22 and functions as a stop to limit the downward movement of the marking implement within the tubular housing 22.

In the embodiment shown in FIG. 3, the tubular housing 22 is designed to accommodate a standard, commercially available, highlighter marking implement such as but not limited to a "MAGIC MARKER" pen or a "HI-LITER" pen marking implement. Thus, the marking and counting probe 20 can be used with different color highlighter marking pens for marking, writing and/or effecting a count of items on a document and, since the end cap 28 is easily secured to and detached from the midsection 32 of the tubular housing 22, different color highlighter pens can be easily and quickly substituted for each other in the marking and counting probe 20.

Figure 4:
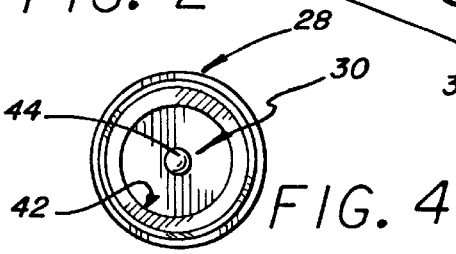
FIG. 4 is a transverse view through the marking and counting probe, taken substantially along lines 4—4 of FIG. 2. and showing end cap of the marking and counting probe.

As shown in FIGS. 2, 3 and 4 the end cap 28 is threadably secured to the midsection 32 of the tubular housing 22. However, other conventional means can also used to secure the end cap 28 to the midsection 32. As with the lower portion of the tubular housing 22, the inside diameter of the tubular portion 42 of the end cap 28 which receives an upper end 94 of the marking implement 90 is, preferably, substantially equal too but somewhat greater than the outside diameter of the marking implement 90 used in the marking and counting probe 20 so that a snug sliding fit is formed between the marking implement 90 and the end cap 28.

As shown in FIGS. 3 and 4, the switch mechanism 30, contained within the end cap 28, has an axially extending plunger 44 which engages a central portion of the upper end 94 of the marking implement 90 housed or mounted in the marking and counting probe 20. When the marking and counting probe 20 is pressed against a surface with a selected pressure or force by gripping the outer surface 40 of the lower portion 38 of the tubular housing 22, the marking implement 90 within the tubular housing slides upward from a fully extended position (shown in FIGS. 1 and 3) to a partially retracted position depressing the plunger 44 to actuate the switch mechanism 30 and effect a count. In the preferred embodiments of the present invention, the switch mechanism 30 is a conventional, relatively inexpensive switch with a spring loaded plunger that returns to its extended position when the selected pressure in no longer applied to the plunger through the marking implement 90. The return of the plunge 44 to its extended position also returns the marking implement 90 from its partially retracted position to its fully extended position.

The amount of force or pressure required to actuate the switch mechanism 30 may be selected to facilitate the counting operation. As in the marking and counting implement disclosed in my U.S. Pat. No. 5,442,380, the force or pressure selected or required to actuate the switch mechanism 30 through the depression of the plunger 44 by the marking implement 90 may be of sufficient magnitude to permit the marking implement 90 to be pressed against a surface with a force sufficient to causes the marking implement 90 to mark or write on a surface without depressing the plunger 44 sufficiently to actuate the switch mechanism 30 and complete the electrical circuit used to send a count signal to a counting and display unit. However, by providing access through the openings 34 and 36 to directly grip the marking implement 90 for marking without counting, with the marking and counting probe 20, the magnitude of the pressure or force required to actuate the switch mechanism 30 through the marking implement 90 may be less than that required to mark with the marking implement.

As schematically shown in FIG. 1, the switch mechanism 30 of the marking and counting probe 20 is electrically connected through an electrical lead 82 to a counter so that when the switch mechanism 30 is actuated. by depressing the plunger 44 a circuit is completed and a count is recorded on the counter 80. Preferably, the counter is a computer, such as a conventional personal computer, and the electrical lead 82 is provided with a conventional electrical service terminal or connection 84 for connecting the marking and counting probe 20 to the input of the computer.

Figure 5:
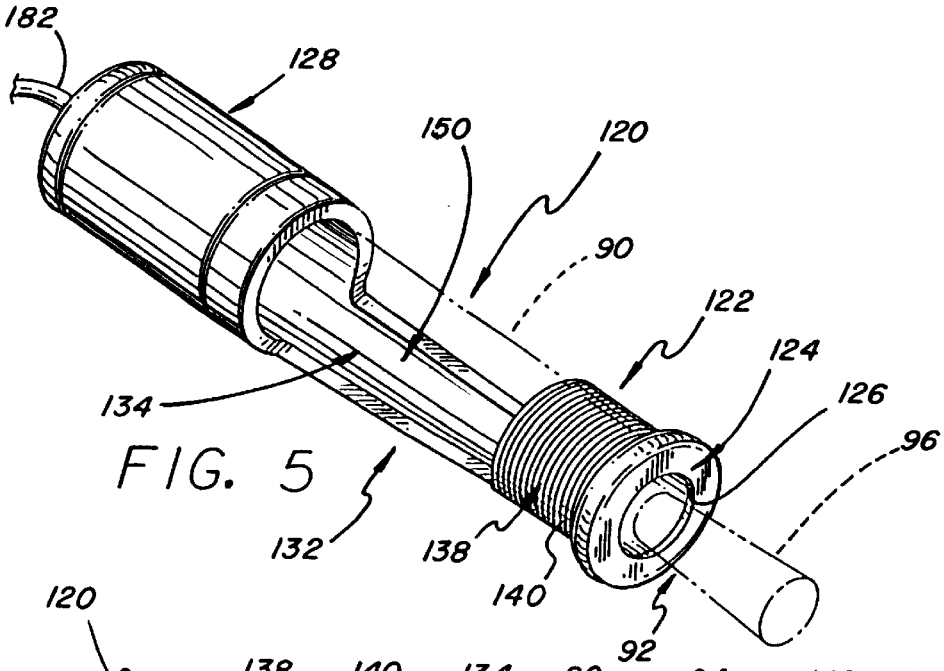
FIG. 5 is a perspective view of a second embodiment of the marking and counting probe of the present invention with a highlighter marking implement shown in phantom line.

FIG. 5 is a perspective view of a second embodiment 120 of the marking and counting probe of the present invention which is electrically connected to a counter 80 (e.g. a personal computer) and, as shown, has a marking implement 90 (e.g. a conventional highlighter pen) housed within the probe. The marking and counting probe 120 of the present invention includes a tubular housing 122 for housing the marking implement 90, such as the highlighter pen. The tubular housing 122 is closed at its lower end 124 except for a centrally located aperture 126 through which the marking end 92 of the marking implement 90 extends when the marking and counting probe 120 is loaded with the marking implement 90 and ready for use. The upper end of the tubular housing 122 of the marking and counting probe 120 is preferably closed by an easily removable end cap 128 which has a switch mechanism 130 incorporated therein.

The tubular housing 122, including the end cap 128, is typically made of black anodized steel or aluminum, plastic, or another suitable material commonly used in the fabrication of pens, mechanical pencils and other marking implements. While, as shown, the outer surface of the tubular housing is generally cylindrical or frusto-conical with a circular transverse cross section, the tubular housing may have other shapes suitable for gripping by a user to mark, write and/or count with the marking and counting probe 120, such as, but not limited to surfaces formed by tubular housings with oval, square, hexagonal and similar transverse cross sections.

As shown in FIGS. 5–8 a midsection 132 of the tubular housing 122 is provided with an openings 134 which provides ready access to the marking implement 90 within the tubular housing 122 so that the marking implement 90 can be directly gripped within the tubular housing by the user with his/her fingers. While the size of the opening 134 can vary, the openings 134 must be sufficiently long and wide to permit the ends of the users fingers to easily or readily pass through the opening and grip the marking implement 90 within the tubular housing 122. As shown in FIGS. 5–8, the opening 134 extends lengthwise for about one and one half to about two inches and across a front portion and into or through the side portions of the midsection 132 of the tubular housing. Preferably, the opening extends around the surface of the midsection 132 of the tubular housing for at least 240°. The upper and lower portions of the tubular housing 122 are connected through the midsection 132 by a longitudinally extending housing segment 150 located at the rear of the marking and counting probe 120.

As shown in FIGS. 5–8 a lower portion 138 of the tubular housing 122 adjacent the lower end 124 of the tubular housing 122 includes an outer surface 140 for gripping the tubular housing without directly gripping the marking implement 90 within the tubular housing 122. The outer surface 140 of the lower portion 138 of the tubular housing 122 can be knurled to facilitate the gripping of the marking and counting probe by the user when the marking and counting probe 120 is being used to mark, write and effect a count.

As in the embodiment of FIGS. 1–4, the inside diameter of the tubular housing 122 is, preferably, substantially equal too but somewhat greater than the outside diameter of the marking implement 90 used in the marking and counting probe 120 so that a snug sliding fit is formed between the marking implement 90 and the tubular housing 122. The opening 126 at the lower end 124 of the tubular housing 122 has a diameter less than that of the marking implement 90 to form an annular shoulder which retains the marking implement within the tubular housing 122 and functions as a stop to limit the downward movement of the marking implement within the tubular housing 122.

In the embodiment shown in FIG. 5–8, the tubular housing 122 is designed to accommodate a standard, commercially available, highlighter marking implement such as but not limited to a "MAGIC MARKER" pen or a "HI-LITER" pen marking implement. Thus, the marking and counting probe 120 can be used with different color highlighter marking pens for marking, writing and/or effecting a count of items on a document and, since the end cap 128 is easily secured to and detached from the midsection 132 of the tubular housing 122, different color highlighter pens can be easily and quickly substituted for each other in the marking and counting probe 120.

Figure 6:
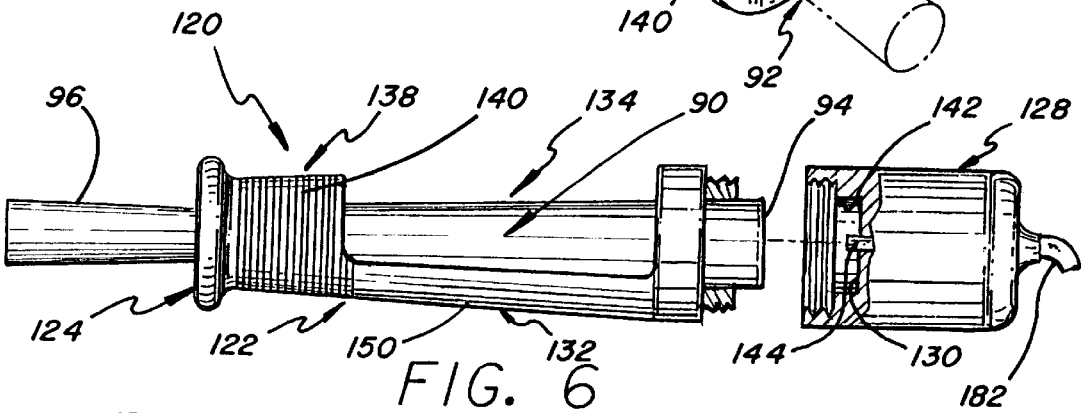
FIG. 6 is an exploded side view, partially in section, of the marking and counting probe of FIG. 5.
Figure 7:
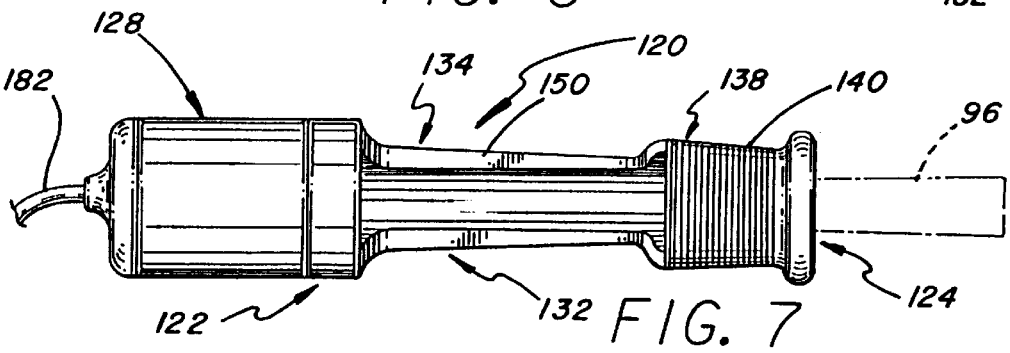
FIG. 7 is a front view of the marking and counting probe of FIG. 5.
Figure 8:
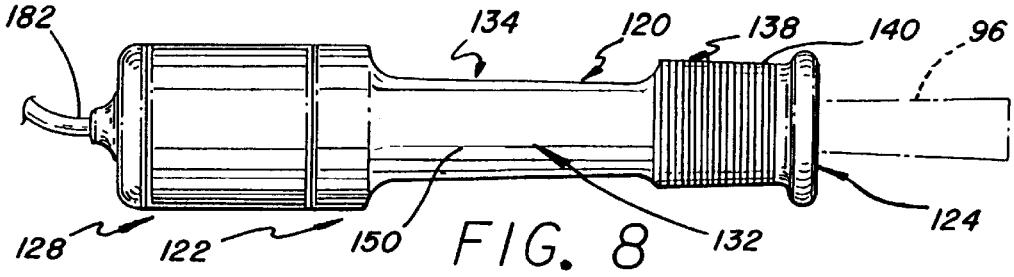
FIG. 8 is a rear view of the marking and counting probe of FIG. 5.

As shown in FIG. 6, the end cap 128 is threadably secured to the midsection 132 of the tubular housing 122. However, other conventional means, not shown, can also used to secure the end cap 128 to the midsection 132. As with the lower portion of the tubular housing 122, the inside diameter of the tubular portion 142 of the end cap 128 which receives an upper end 94 of the marking implement 90 is, preferably, substantially equal too but somewhat greater than the outside diameter of the marking implement 90 used in the marking and counting probe 120 so that a snug sliding fit is formed between the marking implement 90 and the end cap 128.

As shown in FIG. 6, the switch mechanism 130, contained within the end cap 128, has an axially extending plunger 144 which engages a central portion of the upper end 94 of the marking implement 90 housed or mounted in the marking and counting probe 120. When the marking and counting probe 120 is pressed against a surface with a selected pressure or force by gripping the outer surface 140 of the lower portion 138 of the tubular housing 122, the marking implement 90 within the tubular housing slides upward from a fully extended position to a partially retracted position depressing the plunger 144 to actuate the switch mechanism 130 and effect a count. In the preferred embodiments of the present invention, the switch mechanism 130 is a conventional, relatively inexpensive switch with a spring loaded plunger that returns to its extended position when the selected pressure in no longer applied to the plunger through the marking implement 90. The return of the plunger 144 to its extended position also returns the marking implement 90 from its partially retracted position to its fully extended position.

As with the first embodiment 20 of the marking and counting probe, the amount of force or pressure required to actuate the switch mechanism 130 may be selected to facilitate the counting operation. As in the marking and counting implement disclosed in my U.S. Pat. No. 5,442, 380, the force or pressure selected or required to actuate the switch mechanism 130 through the depression of the plunger 144 by the marking implement 90 may be of sufficient magnitude to permit the marking implement 90 to be pressed against a surface with a force sufficient to cause the marking implement 90 to mark or write on a surface without depressing the plunger 144 sufficiently to actuate the switch mechanism 130 and complete the electrical circuit used to send a count signal to a counting and display unit. However, by providing access through the opening 134 to directly grip the marking implement 90 for marking without counting, with the marking and counting probe 120 of the present invention, the magnitude of the pressure or force required to actuate the switch mechanism through the marking implement 90 may be less than that required to mark with the marking implement.

While not shown, as with the embodiment 20 of the marking and counting probe in FIG. 1, the switch mechanism 130 of the marking and counting probe 120 is electrically connected through an electrical lead 182 to a counter so that when the switch mechanism 130 is actuated by depressing the plunger 144 a circuit is completed and a count is recorded on the counter. Preferably, the counter is a computer, such as a conventional personal computer, and the electrical lead 182 is provided with a conventional electrical service terminal or connection for connecting the marking and counting probe 120 to the input of the computer.

Thus, the first and second embodiments 20 and 120 of the marking and counting probe of the present invention each provide a single probe that can be used to mark and write on a surface without effecting a count by directly gripping the marking implement within the probe housing and also, to effect a count of items on the surface by gripping the housing and pressing the marking and counting probe against the surface with a force sufficient to activate the switch within the housing.

As mentioned above, highlighters are generally provided with caps 96 for covering the felt tips of the highlighters to keep the highlighters from drying out when not in use. With most highlighters, a considerable force is required to snap the cap covers 96 for the felt tips into place over the felt tips. With the marking and counting probe of the present invention, by directly gripping a highlighter within the probe, the cap 96 for the felt tip of the highlighter within the probe can be replaced without accidentally effecting a count whatever the force or pressure normally required to actuate the switch mechanisms 30 or 130.

In describing the invention certain embodiments have been used to illustrate the invention and the practice thereof. However, the invention is not limited to these specific embodiments as other embodiments and modifications within the spirit of the invention will readily occur to those skilled in the art on reading this specification. The invention is thus not intended to be limited to the specific embodiments disclosed, but is to be limited only by the claims appended hereto.

What is claimed is:

1. A marking and counting probe comprising: a tubular housing for holding a marking implement which has a marking end and an opposite end; the tubular housing having a sidewall; the tubular housing having a first end with an aperture therein through which the marking end of the marking implement can extend; the sidewall of the tubular housing having a lower portion adjacent the first end providing a surface for gripping the housing; the tubular housing having a second, closed end with a switch means; the switch means being activated by the opposite end of a marking implement when the opposite end of the marking implement is pressed against the switch means by movement of the marking implement relative to the tubular housing in the direction of the second closed end; and the tubular housing having a midsection intermediate the first end and the second closed end; the midsection of the tubular housing having an opening in the sidewall for providing access to directly grip a marking implement within the tubular housing without gripping the sidewall of the tubular housing whereby a marking implement within the tubular housing can be used to mark a surface without activating the switch means by directly gripping the marking implement within the tubular housing and can be used to count by gripping the lower portion of the sidewall of the tubular housing and pressing the marking end of the marking implement against a surface to cause movement of the marking implement relative to the tubular housing to activate the switch means.

2. The marking and counting probe according to claim 1, wherein: the second closed end of the tubular housing is an end cap which can be detached from the midsection of the tubular housing to permit the insertion of a marking implement into and the removal of a marking implement from the tubular housing.

3. The marking and counting probe according to claim 1, wherein: there are a pair of opposed openings in the sidewall of the midsection of the tubular housing to provide access for directly gripping the marking implement within the tubular housing without gripping the sidewall of the tubular housing.

4. The marking and counting probe according to claim 3, wherein: the second closed end of the tubular housing is an end cap which can be detached from the midsection of the tubular housing to permit the insertion of a marking implement into and the removal of a marking implement from the tubular housing.

5. The marking and counting probe according to claim 1, wherein: the opening in the sidewall of the midsection of the tubular housing to provide access for directly gripping the marking implement within the tubular housing without gripping the sidewall of the tubular housing extends across a front portion and into side portions of the tubular housing.

6. The marking and counting probe according to claim 5, wherein: the second closed end of the tubular housing is an end cap which can be detached from the midsection of the tubular housing to permit the insertion of a marking implement into and the removal of a marking implement from the tubular housing.

7. The marking and counting probe according to claim 1, wherein: the opening in the sidewall of the midsection of the tubular housing to provide access for directly gripping the marking implement within the tubular housing without gripping the sidewall of the tubular housing extends across a front portion and into side portions of the tubular housing for at least 240° of the sidewall surface.

8. The marking and counting probe according to claim 7, wherein: the second closed end of the tubular housing is an end cap which can be detached from the midsection of the tubular housing to permit the insertion of a marking implement into and the removal of a marking implement from the tubular housing.

9. The marking and counting probe according to claim 1, wherein: the switch means includes resilient means to prevent the actuation of the switch means to effect a count unless the marking implement is pressed against a surface with a selected activating pressure.

10. The marking aid counting probe according to claim 1, wherein: the switch means is part of an electrical circuit comprising a counter which registers the said switch means is activated.

11. The marking and counting probe according to claim 10, wherein: the counter is a computer electrically connected to the switch means.

12. The marking and counting probe according to claim 1, wherein: the switch means includes an electric service terminal for connecting the marking and counting probe to a computer input.

13. The marking and counting probe according to claim 1, wherein: the tubular housing accommodates a highlighter marking implement.

14. A marking and counting probe comprising: a tubular housing for holding a highlighter marking implement which has a marking end and an opposite end; the tubular housing having a sidewall; the tubular housing having a first end with an aperture therein through which the marking end of a highlighter marking implement can extend; the sidewall of the tubular housing having a lower portion adjacent the first end providing a surface for gripping the tubular housing; the tubular housing having a second, closed end with a switch means; the tubular housing having a midsection intermediate the first end and the second closed end; the second closed end of the tubular housing being an end cap which can be detached from the midsection of the tubular housing to permit the insertion of a marking implement into and the removal of a marking implement from the tubular housing; the switch means including an electrical service terminal for connecting the marking and counting probe to a computer input; the switch means being activated by the opposite end of a highlighter marking implement when the opposite end of the highlighter marking implement is pressed against the switch means by movement of the highlighter marking implement relative to the tubular housing in the direction of the second closed end; and the midsection of the tubular housing having an opening in the sidewall for providing access to directly grip a highlighter marking implement within the tubular housing without gripping the sidewall of the tubular housing whereby a highlighter marking implement within the tubular housing can be used to mark a surface without activating the switch means by directly gripping the highlighter marking implement within the tubular housing and can be used to count by gripping the lower portion of the sidewall of the tubular housing and pressing the marking end of the highlighter marking implement against a surface to cause movement of the highlighter marking implement relative to the tubular housing to activate the switch means.

15. The marking and counting probe according to claim 14, wherein: there are a pair of opposed openings in the sidewall of the midsection of the tubular housing to provide access for directly gripping the highlighter marking implement within the tubular housing without gripping the sidewall of the tubular housing.

16. The marking and counting probe according to claim 14, wherein: the opening in the sidewall of the midsection of the tubular housing to provide access for directly gripping the highlighter marking implement within the tubular housing without gripping the sidewall of the tubular housing extends across a front portion and into side portions of the tubular housing.

17. The marking and counting probe according to claim 14, wherein: the opening in the sidewall of the midsection of the tubular housing to provide access for directly gripping the highlighter marking implement within the tubular housing without gripping the sidewall of the tubular housing extends across a front portion and into side portions of the tubular housing for at least 240° of the sidewall surface.

18. The marking and counting probe according to claim 14, wherein: the switch means includes resilient means to prevent the actuation of the switch means to effect a count unless the marking implement is pressed against a surface with a selected activating pressure.

* * * * *